United States Patent [19]

Smith

[11] 4,119,151

[45] Oct. 10, 1978

[54] CASING SLOTTER

[75] Inventor: Homer Grafton Smith, Houston, Tex.

[73] Assignee: Homco International, Inc., Houston, Tex.

[21] Appl. No.: 771,970

[22] Filed: Feb. 25, 1977

[51] Int. Cl.[2] ..... E21B 43/112; E21B 29/00

[52] U.S. Cl. ..... 166/298; 166/55.3; 175/269

[58] Field of Search ..... 166/298, 55, 55.1, 55.2, 166/55.3, 170, 174; 175/267, 269

[56] References Cited

U.S. PATENT DOCUMENTS

| | | | |
|---|---|---|---|
| 2,215,632 | 9/1940 | Brack et al. | 166/55.3 |
| 2,284,170 | 5/1942 | Santiago | 175/269 |
| 3,005,493 | 10/1961 | Crowe et al. | 166/55 |
| 3,083,765 | 4/1963 | Kammerer | 166/298 |
| 3,225,828 | 12/1965 | Wisenbaker et al. | 166/298 |
| 3,280,913 | 10/1966 | Smith | 166/298 |

*Primary Examiner*—Ernest R. Purser
*Assistant Examiner*—William F. Pate, III
*Attorney, Agent, or Firm*—William Kovensky

[57] ABSTRACT

A drill string mounted tool for cutting a pair of spaced, vertical slots in well tubular goods comprising a pair of knives adapted to be swung outwardly, scissors style, by a piston member, which is in turn operated by well fluid pressure from the surface. Slot cutting is accomplished by vertically reciprocating the drill string carrying the tool with the knives extended.

10 Claims, 12 Drawing Figures

12
14
16
18
26
28
32
34
38
40
41
42
44
46
48
50
52
C 16
18
20
22
24
26
30
32
36
52
54
B 10
12
14
16
18
20
24
26
28
30
32
34
38
40
41
42
44
50

56
58
60
106
104
110
4
5
92
102
97
99
96
80
20
6
86
18
50
7
78
16
12
14
62
10
72
68
65
66
8
18
64
88

FIG. 8
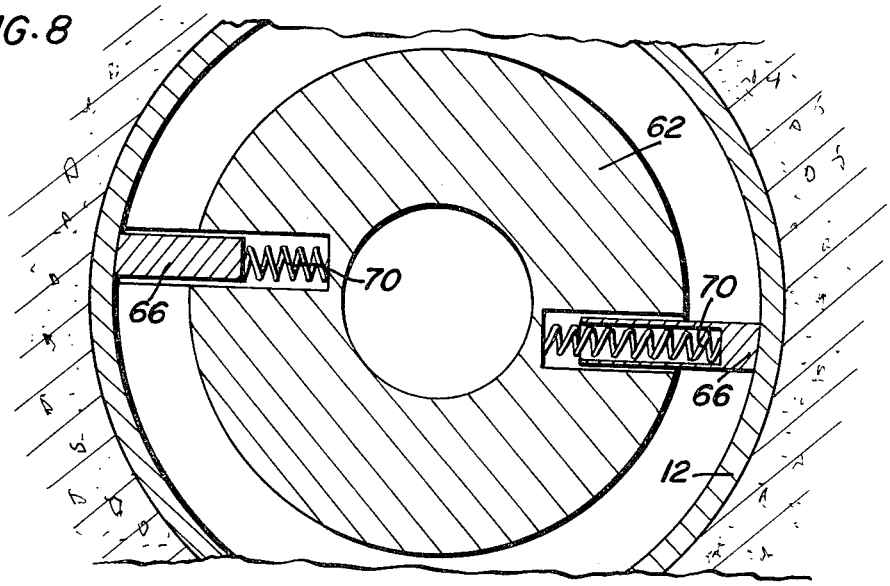
FIG. 7
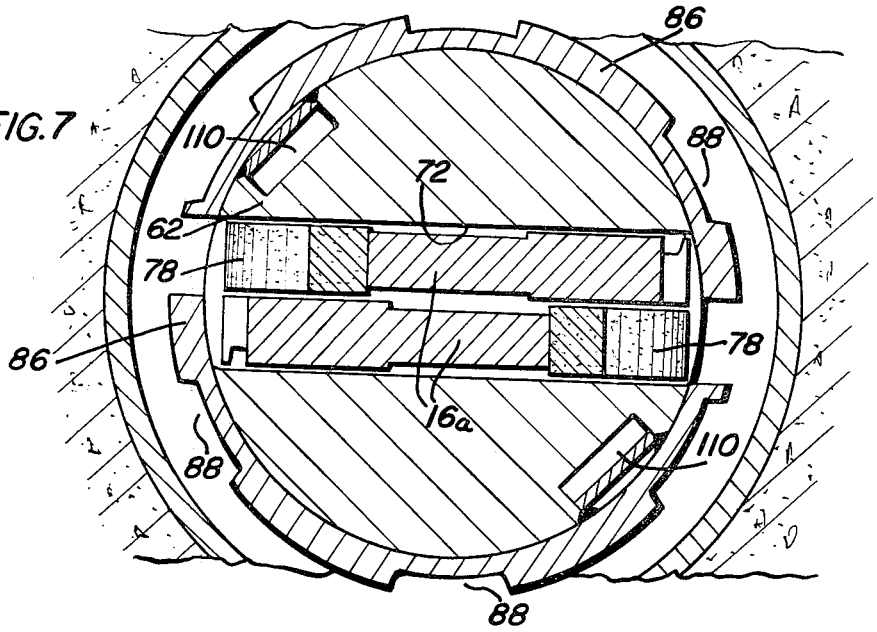
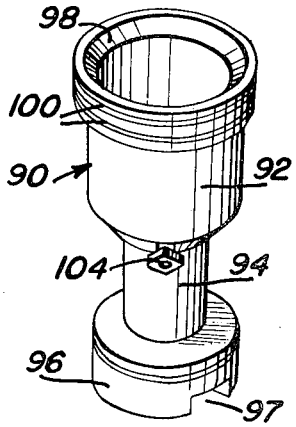
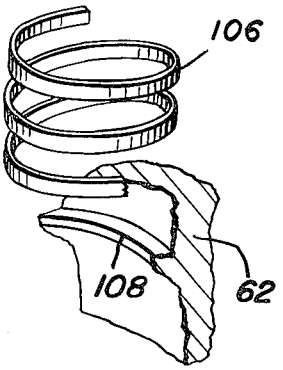
FIG. 9

CASING SLOTTER

This invention pertains to method and apparatus for making vertical slots in the sidewalls of wells, especially cased wells.

A practical vertical slotting tool has not been heretofore generally available. Vertical slots are generally useful in oil and gas wells, particularly as to completion of the well for production. "Completion" means the providing of openings through the casing into the "pay zone" behind the well casing and the cement sheath, to permit fluid flow into the well.

Wells are sometimes completed by setting and cementing casing into the top portion of the producing horizon and leaving the pay zone as "open hole". However, in most cases the casing extends through all, or a major portion of the productive interval and cement is used to fill the space between the casing and the borehole. The casing and the cement sheath are then perforated opposite the selected interval to permit flow of fluids from the formation into the well.

Common commercial perforating techniques include "guns" which employ high explosives to "fire" steel projectiles, or which develop high temperature, high velocity jet streams from "shaped" charges, which penetrate the casing and cement sheath and a portion of the surrounding formation. These methods have certain disadvantages: the guns frequently misfire, and sometimes the projectiles or jets fail to penetrate the casing, which fails to provide a proper perforation and also leaves metallic debris in the well, which is undesirable. Moreover, the use of conventional perforating guns or jets results in a limited number of relatively small perforations at spaced points which, particularly in dense formations of low permeability, may substantially restrict the well's production. The spent bullets and jet cases remain in the formation directly opposite the perforations and may interfere, in varying degrees, with flow through the perforations. Gravel packing the well after perforating is a common technique, but the limited size, both of the individual holes and of the total opening area, of prior methods permits the gravel to plug the flow passageways, thus limiting production. No positive measure of the adequacy or inadequacy of the penetrations made by the perforating guns can be made. Thus, it is extremely difficult to determine whether production is limited by the formation or by the inadequacy of the perforation.

Large perforations and slots are also sometimes made by means of abrasive jet tools whereby a high velocity stream of abrasive particles in a liquid medium is directed against the surface to be penetrated. Major disadvantages are that it requires special pumping equipment to develop the required jet velocity, provides no indication of degree of penetration, and leaves abrasive material in the hole.

Another method of well completion used pre-perforated sections of casing incorporated in the casing string at the desired point. This has the advantage of making it possible to provide larger openings and even slots. It is relatively expensive and troublesome. Moreover, it is difficult to place exactly the perforated section of casing, and an error will result in opening up the well at the wrong level, thus either missing the desired formation altogether or excluding part of the desired formation while opening up adjacent formations which may admit water into the well, seriously limiting or even effectively destroying its useful oil production.

Another important use of casing perforations is in connection with squeeze cementing operations, such as are performed in an attempt to shut off the flow of water from lower zones, close the perforations used in drill stem testing, and improve the bond or seal between the casing and the formation. These cementing operations normally involve forcing a cement slurry through the casing perforations. Where the perforations are formed by a perforating gun or jet as described above, the limited flow capacity of the relatively small, spaced perforations may restrict the efficiency of the operations.

Casing perforations are also used for hydraulic fracturing. While the fracturing fluid can be injected through the multiple spaced perforations created by a perforating gun or jet, it may be more desirable to inject through a single linear opening to concentrate the fluid and achieve greater penetration of the fracture into the surrounding formation. Although such single entry fracturing is usually performed through a horizontal opening, under certain circumstances beneficial results may be achieved by injection through vertical slots in the casing.

Vertical slots are also useful in other types of operations, such as water injection, with or without tracers, ripping of pipe for fishing and other remedial operations, and so on.

The present invention provides a simple, inexpensive, highly reliable, and practical down hole tool for forming vertical slots in well casing or other tubular goods, for the above and other purposes. The tool forms a pair of opposed vertical slots, of any desired length. Since the invention tool is run on well pipe or a drill string, using a flow of drilling mud, no debris is left. The relatively small chips which are milled or cut out of the tubular goods are carried up to the surface in the drilling mud.

Thus the invention provides excellent communication between the bore hole and the surrounding formation, for purposes of well production, or for injection of cement, fracturing, injecting treating liquids, and the like. Further, positive penetration not only of the casing but of the cement sheath behind the casing, and even the adjacent portion of the surrounding formation, if desired, can be obtained.

The invention tool also provides means to relocate the tool in a partially formed slot if it should be necessary to "make a trip" during the slotting operation, i.e., if it should be desired to pull the tool from the hole before the slots are complete for any reason. The invention includes spring loaded fingers, blocks, or guides which locate in the partially formed slots to thereby automatically relocate the tool in order to complete the cutting of the vertical slots, when the tool is returned to the work site. These relocation means also guide the knives in the event the tool or the casing is subjected to a turning force while cutting is proceeding.

The preferred embodiment includes cutting points or knives mounted on blade members which are urged outwardly against the tubular goods to be cut. In the preferred embodiment, cutting occurs on the upstroke only, and therefore camming members operable on the knife carrying blades to urge the knife or cutting point out of the slot during the downstroke are provided. In this manner, the well fluid pump at the surface can be kept running constantly while no cutting occurs on the downstroke. It would be highly undesirable, for well known reasons, to have to operate the surface pump on and off for every stroke of the tool up and down in the hole. These cams force the knife carrying blades inwardly toward each other, pulling the knives out of their slots, during the down or idle stroke. The guide blocks meanwhile hold the tool with the knives lined up with the slots so that cutting can continue on the upstroke when the cams rotate and the blades may swing outwardly again.

Thus the invention provides a drill string operated tubular goods vertical slotting tool of the character described, which is highly reliable in operation, of relatively low cost, simple to manufacture and maintain, and yet practical and efficient to a high degree in use.

The above and other advantages of the invention will be pointed out or will become evident in the following detailed description and claims, and in the accompanying drawing also forming a part of this disclosure, in which:

Figures 2, 3:
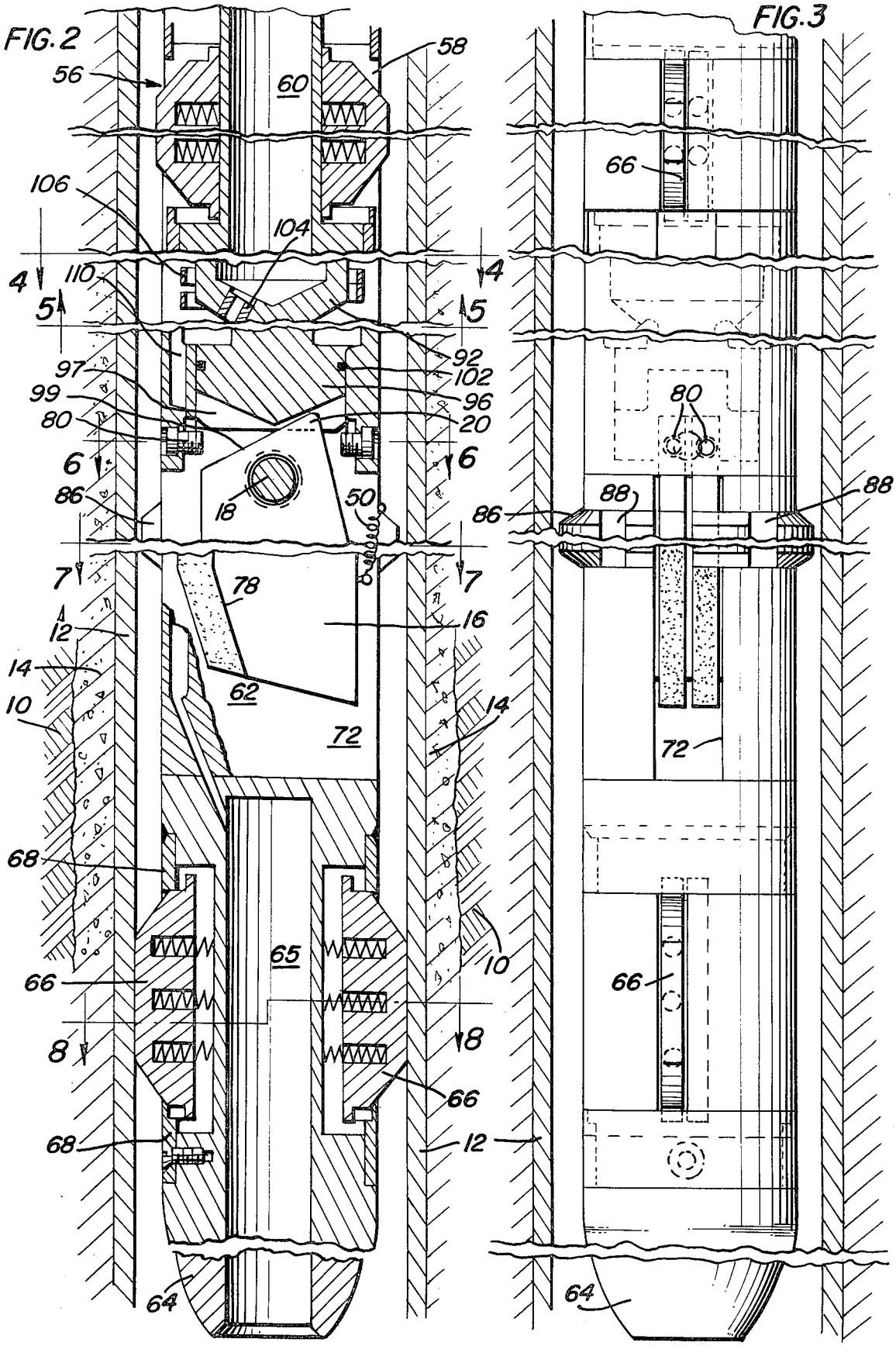
FIG. 2 is a more mechanical showing of a specific tool, useable to mount both the preferred embodiment blade and knife structure of FIG. 1, as well as the double stroke cutting knife of the remaining FIGS.
FIG. 3 is a vertical view taken generally at right angles to FIG. 2.

FIGS. 4, 5, 6, 7, and 8 are cross-sectional views taken on their respective cutting lines shown in FIG. 2; and FIG. 9 is a two part perspective showing of a detail.

Referring now in detail to the drawing, 10 indicates a bore hole in the earth, which is cased by casing or other well tubular goods 12, which is in turn mounted in place by a cement sheath 14. The structure 10, 12 and 14 is conventional in the well drilling arts. The term "well sidewall" as used in the specification and claims herein shall be understood to mean any well in which the invention may be used, cased or uncased, and other environments which may present themselves. A pair of blade members 16 are pivotally mounted on a main pivot pin 18. Pin 18 is part of the tool of the invention shown in greater detail in FIG. 2 et. seq., and described in greater detail below. FIG. 1 is somewhat diagramatic for the purpose of illustrating the manner of operation of this preferred form of the blades 16. Accordingly, certain parts have been omitted and/or shown diagramatically in FIG. 1, the later FIGS. are in sufficient detail to teach a modus operandi for these blades 16 as well as for the cutting members **16*a*** shown therein.

Blades 16 may be identical to each other, reversed in their mounting on pin 18, formed of flat steel, and each comprises an upper operating end portion 20 of a main body portion which is separated by a shoulder 22 from a lower body portion 24. The body has a protrusion 26 provided merely for manufacturing convenience. The reduced thickness lower body portion carries a cutting knife member 28 held in place by suitable mounting means, such as silver soldering. The knife members 28 have the general configuration of machine tool cutting points, and may be formed of tough grades of tool steel, carbide materials, and the like. Carbide materials are preferred for their well known advantages, including a relatively long useful life without dulling.

Figure 1C:
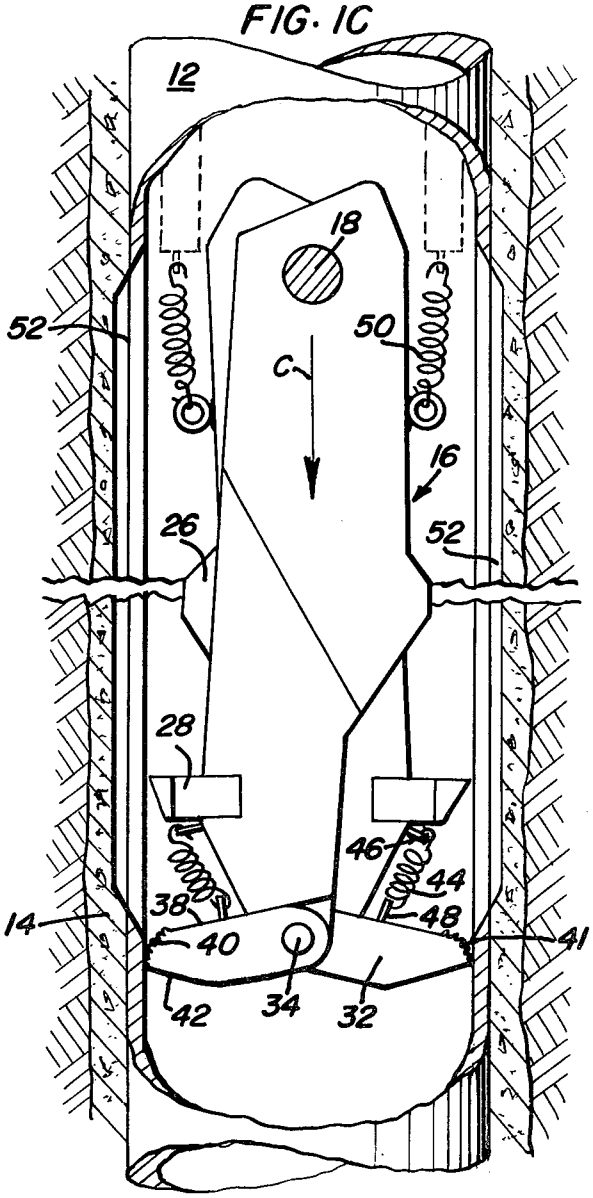
FIGS. 1A, 1B and 1C are a somewhat schematic showing of the preferred embodiment illustrating its operation with many parts being omitted and/or shown schematically.
Figure 1B:
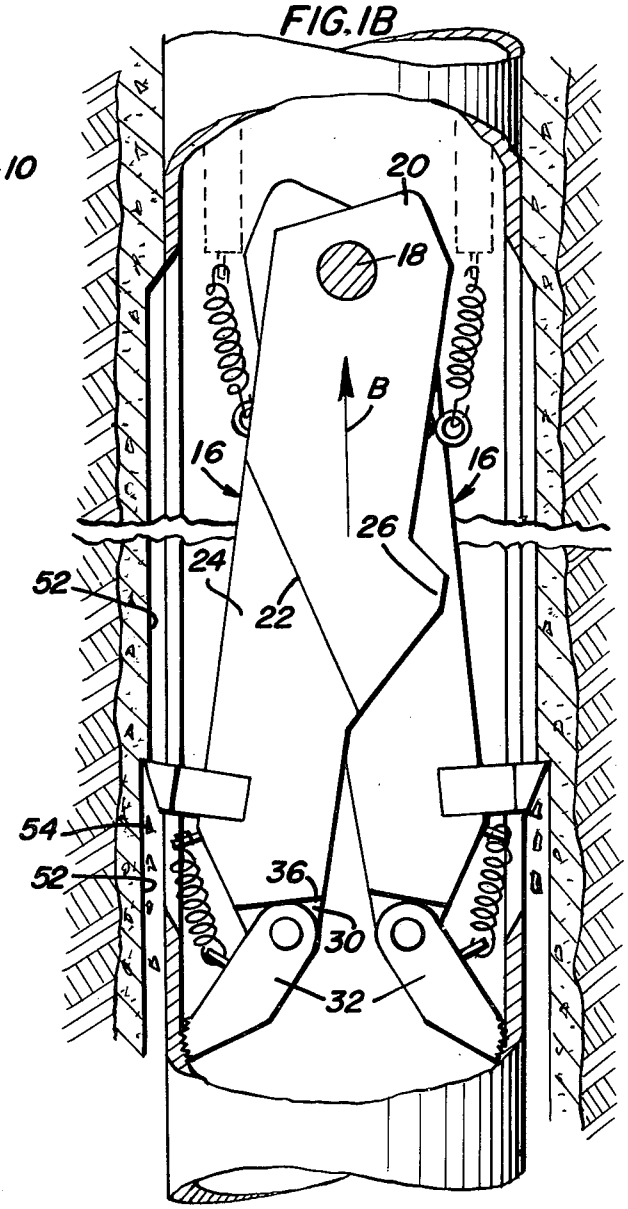
Figure 1A:
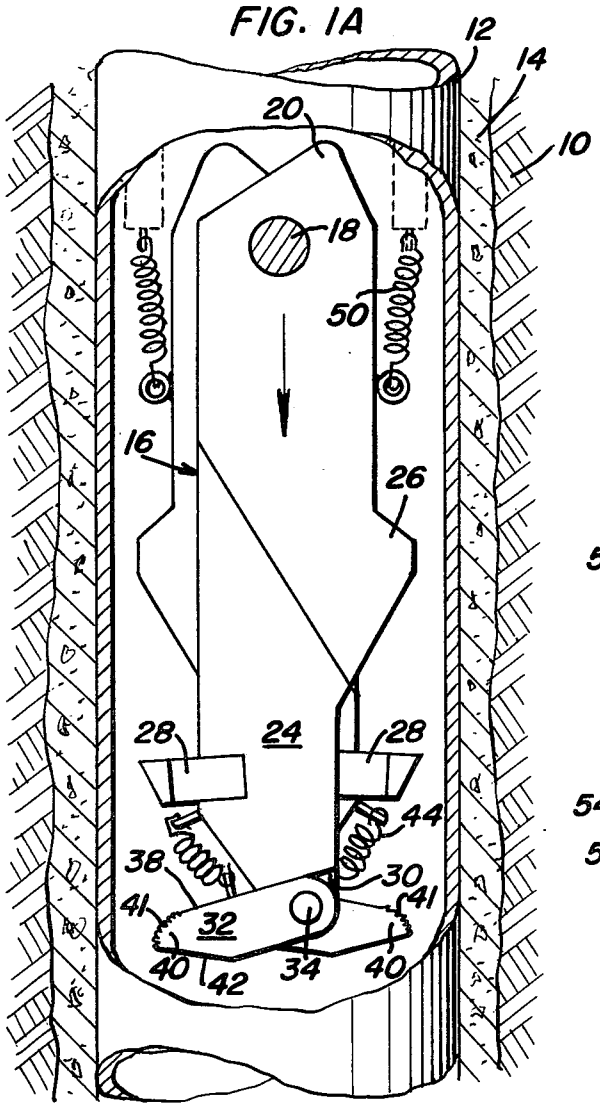
Figure 1D:
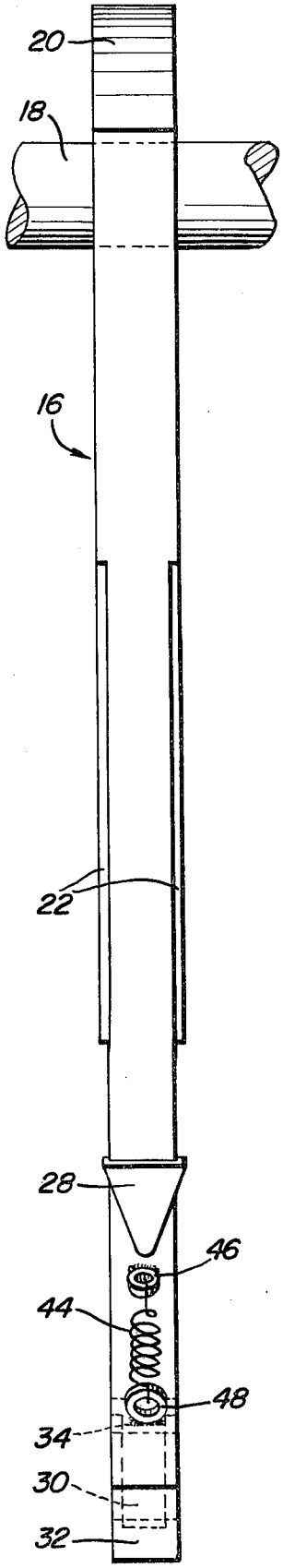
FIG. 1D is a side elevational view of one of the blades of FIGS. 1A–1C.

The lower end of portion 24 of the blade 16 is formed into a reduced thickness tang portion 30 which carries a cam member 32 mounted on a pivot pin 34, see FIG. 1D. The tang 30 is defined by a pair of shoulders 36 on opposite sides of the blade. The inner or pivot pin ends of the cams 32 are bifurcated to slidingly accept tang 30. Shoulders 36 thus act as stops to define an extended position of the cams, as shown in FIG. 1C, in which position the knives are moved out of cutting relationship with the casing 12. The cam 32 has an upper flat surface 28 which extends to a nose portion 40 which is rounded on its top surface and which is defined by a flat 42 on its underside. Thus, a point or edge is formed at the outer end of the cam 32 at the junction of the rounded nose 40 and the lower flat 42. The rounded nose 40 is covered with a suitable material to increase the friction between cam 32 and the casing. Bonded carbide materials have been successfully used. Thus, on each downstroke, the cam first grips, then rotates, and then slides.

Means are provided to normally urge the cams 32 into their extended position shown in FIGS. 1A and 1C. To this end, each cam is associated with a tension spring 44 which is trained between an upper anchor 46 secured to portion 24 and a lower anchor 48 secured to the upper cam surface 38. In the successfully constructed embodiment anchors 46 and 48 were simply washers welded in place as shown.

In a similar manner, means are provided to normally urge the blades 16 inwardly towards each other, to the position shown in FIG. 1A. To this end, a pair of tension springs 50 are secured between suitable anchors on the bodies of the blades 16, and any other convenient part of the tool. It is an important advantage of the present invention that the cams 32 permit the pump and other surface equipment to operate continuously.

OPERATION OF THE PREFERRED EMBODIMENT OF FIGS. 1

FIG. 1A shows the tool in an inoperative position with the drill string not pressurized. The blades are in a vertical folded position, and the cams are in their normal extended position. Spring means 50, described above, are provided to hold the blades in this position to prevent accidental contact between the tool and the casing 12 or the like from spreading the blades apart prematurely.

FIGS. 1B and 1C should be viewed together, in that they show the alternate strokes (as indicated by the arrows B and C respectively) by which the invention tool makes the elongated slots 52 in the casing 12 and the cement sheath 14. After the tool has been lowered in the FIG. 1A configuration to the desired location, the drill string is pressurized to move the blades out to the FIG. 1B position. The tool is then alternately moved in an upward cutting stroke shown in FIG. 1B and an idle or return stroke shown in FIG. 1C.

The knife members 28 have the general configuration of a machine tool cutting point. This particular shape has been found to be extremely efficient, of low cost, proven and well known technology, cuts accurate slots, and with relatively long tool life. However, such tools, that is knives or points 28, have the disadvantage that they do not cut well on the down stroke and are susceptible to breakage when subjected to upward forces.

The cams 32 permit the use of these knives, while causing them to retract in the return FIG. 1C stroke, while at the same time not requiring that the pumps at the surface which pressurize the blades be turned off. As explained in detail below, force is applied at the operating ends 20 of the blades 16 to urge them apart, i.e., towards the FIG. 1B position.

Cams 32 are normally in the FIG. 1A and 1C position. That is, the springs 44 urge them upwardly with their upper edges 38 resting against the stops defined by the shoulders 36. When the tool is working, the cams are in constant contact with the casing. When the tool is making an upward cutting stroke, FIG. 1B, the cams are rotated downwardly, tensioning the springs 44, and slide harmlessly against the inside of the casing 12. Upon the completion of a cutting stroke, downward motion of the tool causes the friction noses 40 to grip or "dig" into the casing. Continued downward tool motion will cause the cams to rotate about pin 34 and swing the knives out of their slots 52 around pivot pin 18. When the cams are fully rotated against shoulders 36, the friction ends 41 of the rounded noses 40 slide down the casing 12. These portions are made sufficiently wide and rugged to withstand these forces. On the next cycle, upward tool movement causes the cams to again swing down to the FIG. 1B position to permit the knives to re-enter slots 52 and continue cutting.

The length of the vertical slots 52 is controllable from the surface. That is, the tool will continue to cut as long as it is being raised in a cutting stroke, without limit, as to the invention tool. Thus, the invention gives petroleum engineers heretofore unavailable flexibility in completing wells so as to accommodate relatively thick and relatively unproductive zones for example, and for cementing, and various other reasons, as is known and as set forth above.

The thickness into the drawing of the cams 32 may be greater than the thickness of the knives 28, whereby any possibility of the cams falling into the partially formed vertical slots 52 during a cutting operation is avoided.

FIG. 1B shows the invention in the act of enlarging the vertical slots 52, the chips 54 from the cutting operation being indicated therein. FIG. 1C could illustrate either a partial or completed slot 52. That is, the slot 52 could be deepened still further into at least the cement sheath 14, if desired.

FIGS. 2 and 3 et seq. show a tool 56. This tool is the carrier for the blades 16 of the first embodiment, but is shown here fitted with a second embodiment of blades 16*a*. That is, the tool 56 of FIGS. 2 et seq. can be used to mount either the preferred embodiment blades 16 and to perform its mode of operation or the second embodiment blades 16*a* and their mode of operation. Any parts in FIG. 2 et seq. the same as or similar to parts already described, are often indicated by the same reference numeral followed by "*a*".

The tool 56 is run into the hole on a conventional drill string, work string, or the like, which may include a number of drill collars for the purpose of adding weight. The tool is connected to the string by a connector portion 58 forming the upper end of the tool. Only the lowermost end of this portion 58 is shown in the drawing, it being understood that the upper end is formed with suitable threads, passageways, and the like to connect the tool 56 onto a drill string in the usual manner. Top portion 58 is formed with a central through opening 60 through which pressurized drilling mud from the surface is delivered. Completing the main structural members of the tool, the lower end of the main body 62 carries a nose piece 64 to guide the tool down the hole.

Means are provided to locate and relocate the tool in partially or completely cut slots. Relocation is often necessary, as when the tool is lifted to replace the knives or cutting points 28 as would be routinely required as dulling occurs in normal use. If there were no such means for relocation, the partial slots formed by the first set of knives could be wasted, there being no guarantee that the tool could relocate itself into such partially formed slots. Further, these same means also hold the knives or cutting means aligned with the slots they are forming during normal operation. At least one of the two sets of blocks will always be in the slots. Thus, the effect of any torque present at the work site which might otherwise cause damage or move the cutting members out of the slots is avoided.

Figure 4:
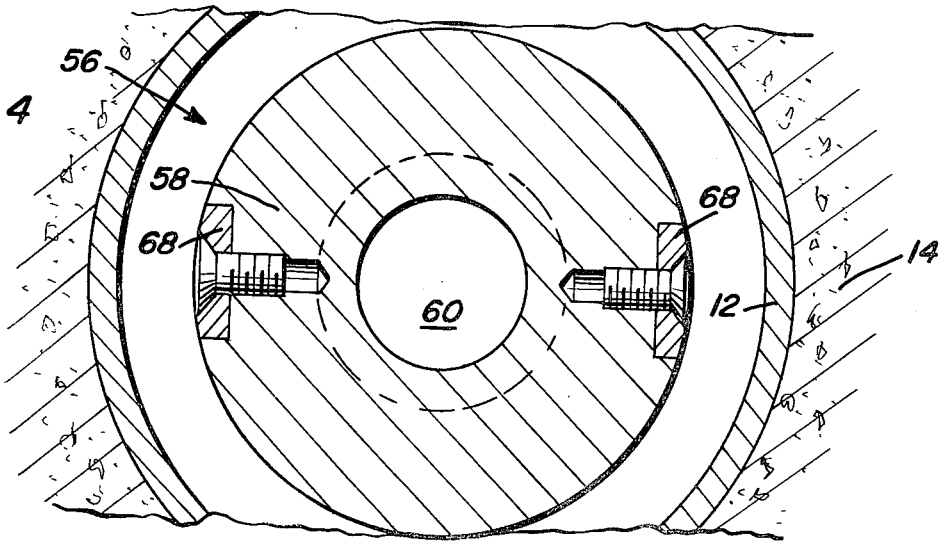

For these purposes, the tool 56 is provided with upper and lower blocks 66 which are retained in place at their upper and lower ends by rings 68 which are screwed or otherwise secured in place, see FIG. 4. The upper blocks are in the upper connector portion 58, while the lower blocks are in the lower end of the main body 62. Aside from this location difference the upper and lower guide blocks are identical. This feature can be seen in FIG. 8. Each block 66 is formed with a plurality of blind openings in each of which is contained a spring 70. The springs normally urge the blocks 66 outwardly against the inside of the casing 12. It is also thought that various kinds of structures to hold these blocks in while making a "trip" in and out of the well could be provided. Various destructible straps, pins or the like, for example, could be provided for this purpose.

In operation, the guide blocks are urged by the springs outwardly against the casing, and slide thereon while the tool is being raised or lowered. To relocate, when the level of the slots is reached at the end of such a "trip", the tool is rotated very slowly until the blocks 66 fall into the partially formed slots, at which time resistance to further rotation will be sensed at the surface, informing the operator that the slots have been relocated, and that rotation should cease and reciprocation to finish cutting the slots can continue.

For simplicity of assembly, it has been found convenient to weld the upper guide ring 68 in place in the tool, and to mount the lower guide ring in place with screws, and to make it of a split configuration, so as to facilitate its removal, to in turn permit removal of the spring loaded guide blocks for their maintenance and other routine purposes.

Figure 6:
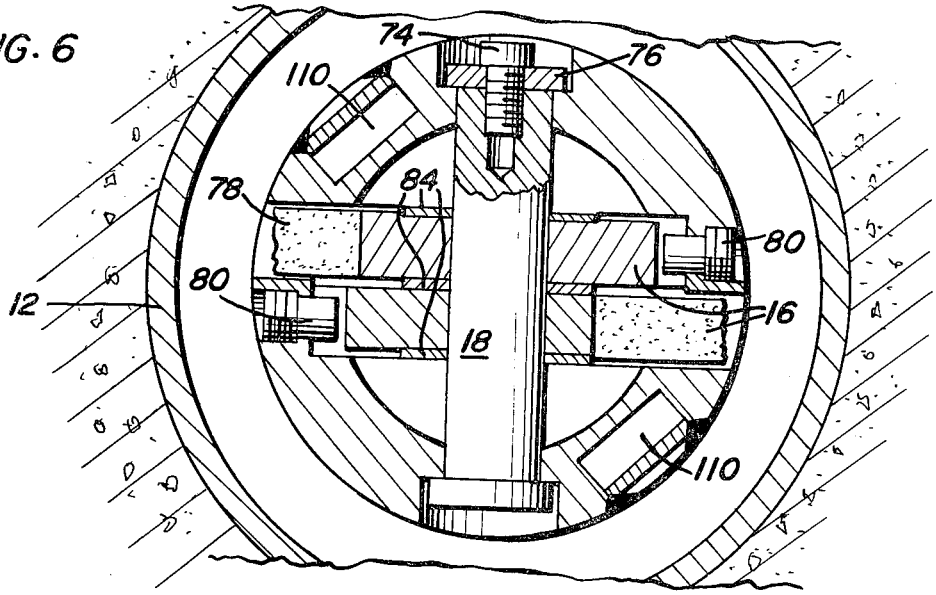

FIGS. 2, 3, and 6 best illustrate the manner in which the knives 16*a* are mounted in the main body 62 of the tool 56. For this purpose, said body is formed with an elongated slot 72 which is wide enough and long enough to accommodate the full length of the knives 16*a*. At its upper end, the main pivot pin 18 bridges across this slot, and is retained by means of a bolt 74 and large washer 76 so as to permit removal of the pin 18, as shown in FIG. 6, for replacement of the knives 16*a*, as required. Means are provided to control and limit the amount of angular rotation of the knives about the pivot pin 18, so as to control the amount of penetration of the cutting edges 78 of the knives through the casing, cement sheath, and finally the formation 10. To this end, each knife is associated with an adjustable limit pin 80 which is so located as to be struck by the upper end of the knife. As is readily apparent from FIGS. 2 and 6, by suitably fixing pin 80 along its axis, the total rotation of the associated knife 16*a* can be controlled. The cutting edge 78 of the knife is preferably a tough, rugged material, such as a bonded carbide sold by the assignee of the present application, known in the trade as "Klustrite" (registered trademark). Suitable spacer washer members 84, formed of steel or other suitable material, are provided between the knives, and between the knives and the wall of the slot 72 to facilitate smooth motion of the knives during their swinging action, and to keep the knives properly spaced from the tool body. Thus, the term "cutting means" and the like as used in the specification and claims herein shall be understood to mean both the FIGS. 1 and 2 knives, such coatings, and all equivalent means adapted to cut tubular goods.

Referring to FIGS. 2, 3, and 7, a stop member 86, in the form of a split ring, is provided, half on each side of the tool, for each of the blades to limit their outward motion. Split rings 86 are formed with a plurality of grooves 88 to permit flow of mud around the outside of the tool. Rings 86 may be held in place by screws, welding, or any other suitable means. As shown in FIG. 7, one end of each half of member 86 overlies only one of the blades to thereby stop and define the limit of outward blade swinging motion. In addition, split ring 86 serves as a stabilizer to help keep the tool centered in the well.

Figure 5:
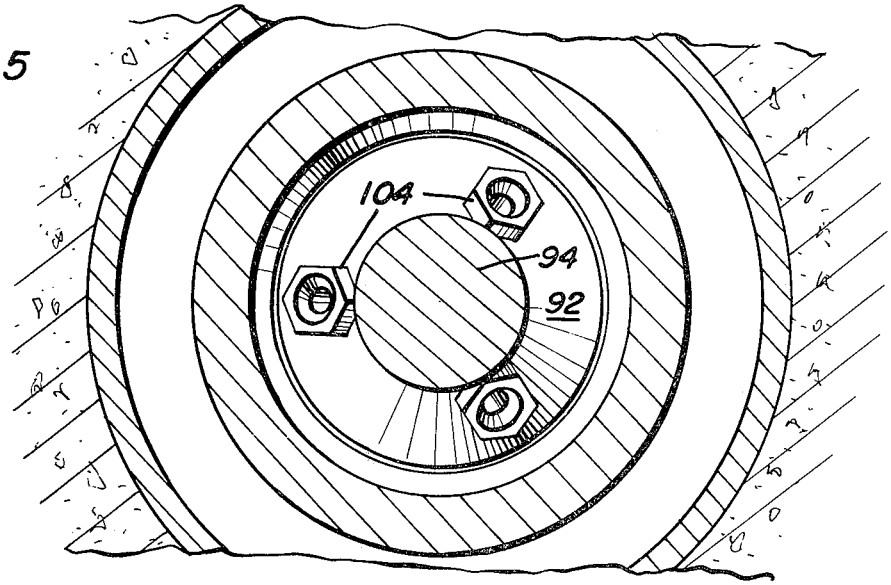

A piston 90, shown best in FIG. 9 and also appearing in FIGS. 2 and 5, is provided in the body 62 of the tool, to urge the blades 16 or **16*a* outwardly around the pivot 18 to bring the points 28 or edges 78 into cutting engagement with the casing. Piston 90 comprises an upper cup portion 92 connected by a shank portion 94 to a lower portion 96. The upper end of the upper cup portion 92 is formed into an upper lip portion 98 which carries a plurality of O-rings 100 which form a suitable seal to the adjacent portion of a suitably formed opening in the body member 62. The main part of the cup 92 extends, at a reduced diameter, downwardly from this upper lip portion 98. The lower portion 96, shown in FIG. 2, carries an O-ring or other suitable sealing means 102. The underside of the bottom of the upper cup member 92 carries a set of three nozzle members 104, which communicate the space inside this cup with the space around the shank portion 94. The total cross-sectional area provided by the three nozzle members 104 is such as to provide a predetermined pressure drop across the piston, in order to achieve a predetermined operation of the knives 16 or 16*a***.

Means are provided to urge the piston member 90 upwardly, see FIGS. 2 and 9. To this end, a flat stock coil spring 106 is provided inside the main body 62 positioned between the underside of the upper lip 98 of the upper cup 92, and an appropriate ledge 108 formed on the inside of the body member 62. The inside diameter of the ledge 108 is sufficiently large to permit clearance of the lower cup 96 therethrough when assembling the piston into the tool. The coils of the spring are flat in the direction of the axis of the spring so as to facilitate its being fitted into this relatively narrow space. The lower end of the lower portion 96 is formed with a slot 97; see FIGS. 2 and 9. The slot 97 is of a shallow "V" configuration; an angle of about 15°–18° up from the horizontal on each side is currently preferred. The upper end of the blades 16 or **16*a* comprises a flat surface 99 which contacts the inside end of the "V" slot during normal operation of the tool. Of course, the companion blade will contact the left side of the slot, referring to FIG. 2. By having the piston in precise contact with the blades, a "crisp" operation with no "slop" is achieved. The parts are dimensioned to achieve this desiratum. The angular relationship achieves an advantageous high leverage effect to swing the blades outwardly in cutting relationship to the casing. The slot 97** also serves an additional guiding function to help hold the blades properly aligned.

Each blade contacts only one side of the "V" slot 97 at any one time. It may be possible to configure blade top surface 99 in such a way that the portion of that surface which is not used in swinging the blade outwardly could be used to define a stop or limit to such outward motion. This function, in the embodiment shown, is provided by the adjustable pins 80. However, in a suitable environment, the piston/blade top end parts could be configured to accomplish both the swing function and the stop function. Another variation of this idea would be to so configure these parts that they would operate in conjunction with the adjustable stop means 80 to provide a backup or alternate stop means.

In operation, with either knives 16 or **16*a*, after the tool is run into the hole to the proper location, the string is pressurized, and the pressure is present at the passageway 60, and into the upper cup 92. The pressure is relieved slowly through the nozzles 104, the drilling fluid then passing through passageways 110 and 116, then through central opening 65, and then past the long slot 72 in the sides of the tool and around the outside of the tool on the return to the surface. The passageway 116 assures a proper cleansing mud flow both through as well as around the outside of the tool. This path of the drilling fluid serves the additional functions and provides the additional advantages of both washing the chips 54 away as they are formed, and washing over the cutting edges 78 of the knives 16*a* or over the points 28, to thereby keep their cutting edges cool and clean in operation. The piston is urged downwardly against the upper ends of the blades, and cutting is accomplished in the manner set forth. In the preferred embodiment, the cutting is only on the upstroke, the cams 32 serving to swing the knives 28 out of the slots on the downstroke. The blocks 66 keep the tool properly orientated with respect to the slots on the idle stroke. In the second embodiment, portions 78** cut on both strokes.

While the invention has been described in detail above, it is to be understood that this detailed description is by way of example only, and the protection granted is to be limited only within the spirit of the invention and the scope of the following claims.

What is claimed is:

1. A tool for forming vertical slots in a well sidewall, said tool comprising means to mount said tool on a drill string in fluid flow communication therewith, said tool comprising knife means, means to mount said knife means in a retracted position within said tool, means responsive to pressurization of the well fluid to move said knife means into cutting relationship with the well sidewall, whereby said tool will cut said vertical slots in said well sidewall upon said tool and said drill string being vertically reciprocated in said well, said knife means comprising a pair of blades mounted on a pivot pin in said tool for motion in a scissor-like manner, said knife means comprising a pair of machine tool-like knife points mounted one on each of said blades, means to move said knife points out of cutting relationship with said well sidewall on each downstroke of said tool in said well, said means to move said knife points out of cutting relationship comprising a pair of cams pivotally mounted one at the lower end of each of said blades, stop means defining an extended position of each cam wherein a portion of said cam extends radially outwardly of said tool a greater distance than the radially outwardly extend of said cutting point, said cam being moved into said extended position during each downstroke of said tool in said well, said cam having a nose portion adapted to slide on said sidewall during each upstroke of said tool, whereby on each upstroke said cam rotates away from said extended position about its pivot on its respective blade to permit the pressurized well fluid to extend said blade to urge said knife points into their cutting relationship.

2. The combination of claim 1, and spring means urging said cams toward their extended positions.

3. A tool for forming vertical slots in a well sidewall, said tool comprising means to mount said tool on a drill string in fluid flow communication therewith, said tool comprising knife means, means to mount said knife means in a retracted position within said tool, means responsive to pressurization of the well fluid to move said knife means into cutting relationship with the well sidewall, whereby said tool will cut said vertical slots in said well sidewall upon said tool and said drill string being vertically reciprocated in said well, said knife means comprising a pair of blades mounted on a pivot pin in said tool for motion in a scissor-like manner, said knife means comprising a pair of machine tool-like knife points mounted one on each of said blades, means to move said knife points out of cutting relationship with said well sidewall on each downstroke of said tool in said well, said means to move comprising a pair of cams each having a nose portion and a bifurcated inner end, each of said blades having a lower tang end to mount the bifurcated cam end thereon via pivot means, a shoulder on said blade cooperable with said cam to define an extended position of said cam, spring menas urging said cams to their extended positions, said cams having a length such that the knife points are moved out of said cutting relationship when said cams are extended, and the nose portion of each cam being adapted to slide on said sidewall to rotate said cam on its pivot means to permit said knife points to be moved by the pressurized well fluid into cutting relationship in response to upward movement of said tool in said well.

4. A tool for forming vertical slots in a well sidewall, said tool comprising means to mount said tool on a drill string in fluid flow communication therewith, said tool comprising knife means, means to mount said knife means in a retracted position within said tool, means responsive to pressurization of the well fluid to move said knife means into cutting relationship with the well sidewall, whereby said tool will cut said vertical slots in said well sidewall upon said tool and said drill string being vertically reciprocated in said well, said knife means comprising a pair of blades mounted on a pivot pin in said tool for motion in a scissor-like manner, and means to hold said knife means in said retracted position comprising a retractor spring mounted between each of said blades and other portions of said tool.

5. A tool for forming vertical slots in a well sidewall, said tool comprising means to mount said tool on a drill string in fluid flow communication therewith, said tool comprising knife means, means to mount said knife means in a retracted position within said tool, means responsive to pressurization of the well fluid to move said knife means into cutting relationship with the well sidewall, whereby said tool will cut said vertical slots in said well sidewall upon said tool and said drill string being vertically reciprocated in said well, said knife means comprising a pair of blades mounted on a pivot pin in said tool for motion in a scissor-like manner, and stabilizer means on said tool to guide said tool to a centered position in said well, said stabilizer means comprising a split ring member each half of which cooperates with a respective one of said blades to define a maximum limit of outward extend of said blade.

6. A tool for forming vertical slots in wells comprising means to mount said tool on the lower end of a drill string, said tool comprising a pivot pin, a pair of blade members mounted on said pivot pin, knife means on said blade members adapted to cut said vertical slots in said well, means operable by pressurized fluid from the surface delivered down said drill string to swing said blade members outwardly about said pivot pin to bring said knife means in contact with said well, means to move said tool vertically in said well bore with said knife means in cutting relationship to said well, said knife means comprising a pair of machine tool like knife points mounted one on each of said blades, means to move said knife points out of cutting relationship with said well on each downstroke of said tool in said well, said means to move comprising a pair of cams each having a nose portion and a bifurcated inner end, each of said blades having a lower tang end to mount the bifurcated cam end thereon via pivot means, a shoulder on said blade cooperable with said cam to define an extended position of said cam, spring means urging said cams to their extended position, said cams having a length such that the knife points are moved out of said cutting relationship when said cams are extended, and the nose portion of each cam being adapted to slide in the well to rotate said cam on its pivot means to permit said knife points to be moved by the pressurized well fluid into cutting relationship in response to upward movement of said tool in said well.

7. A tool for forming vertical slots in wells comprising means to mount said tool on the lower end of a drill string, said tool comprising a pivot pin, a pair of blade members mounted on said pivot pin, knife means on said blade members adapted to cut said vertical slots in said well, menas operable by pressurized fluid from the surface delivered down said drill string to swing said blade members outwardly about said pivot pin to bring said knife means in contact with said well, means to move said tool vertically in said well bore with said knife means in cutting relationship to said well, said knife means comprising a pair of machine tool-like knife points mounted one on each of said blades, means to move said knife points out of cutting relationship with said well on each downstroke of said tool in said well, said last mentioned means comprising a pair of cams pivotally mounted one at the lower end of each of said blades, stop means defining an extended position of each cam wherein said cam extends radially outwardly of said tool a greater distance than the radially outwardly extent of said cutting point, said cam being moved into said extended position during each downstroke of said tool in said well, said cam having a nose portion adapted to slide in the well during each upstroke of said tool, whereby on each upstroke said cam rotates away from said extended position about its pivot on its respective blade to permit the pressurized well fluid to extend said blade to urge said knife points into their cutting relationship.

8. The combination of claim 7, and a friction increasing means on each of said cam nose portions.

9. A tool for forming vertical slots in wells comprising means to mount said tool on the lower end of a drill string, said tool comprising a pivot pin, a pair of blade members mounted on said pivot pin, knife means on said blade members adapted to cut said vertical slots in said well, means operable by pressurized fluid from the surface delivered down said drill string to swing said blade members outwardly about said pivot pin to bring said knife means in contact with said well, means to move said tool vertically in said well bore with said knife means in cutting relationship to said well, and means to hold said knife means in said retracted position comprising a retractor spring mounted between each of said blades and other portions of said tool.

10. A tool for forming vertical slots in wells comprising means to mount said tool on the lower end of a drill string, said tool comprising a pivot pin, a pair of blade members mounted on said pivot pin, knife means on said blade members adapted to cut said vertical slots in said well, means operable by pressurized fluid from the surface delivered down said drill string to swing said blade members outwardly about said pivot pin to bring said knife means in contact with said well, means to move said tool vertically in said well bore with said knife means in cutting relationship to said well, and stabilizer means on said tool to guide said tool to a centered position in said well, said stabilizer means comprising a split ring member each half of which cooperates with a respective one of said blades to define a maximum limit of outward extent of said blade.

* * * * *